United States Patent [19]

Mitsuda et al.

[11] 4,179,882

[45] Dec. 25, 1979

[54] APPARATUS FOR CONTROLLING THE AMOUNT OF SECONDARY AIR FED INTO AN INTERNAL COMBUSTION ENGINE

[75] Inventors: Tadao Mitsuda; Minoru Iwata, both of Susono; Masatoshi Sugiura; Shigetaka Takada, both of Obu; Yukihiro Watanabe, Nagoya, all of Japan

[73] Assignees: Toyota Jidosha Kogyo Kabushiki Kaisha; Aisan Idustry Co., Ltd., both of Toyota, Japan

[21] Appl. No.: 912,007

[22] Filed: Jun. 2, 1978

[30] Foreign Application Priority Data

Oct. 15, 1977 [JP] Japan ..... 52-123002

[51] Int. Cl.[2] ..... F01N 3/10

[52] U.S. Cl. ..... 60/276; 60/290

[58] Field of Search ..... 60/276, 290, 289; 123/32 EE, 124 R, 124 B, 119 EC

[56] References Cited

U.S. PATENT DOCUMENTS

| | | | |
|---|---|---|---|
| 3,962,867 | 6/1976 | Ikeura | 60/290 |
| 4,077,207 | 3/1978 | Hattori | 60/276 |
| 4,119,072 | 10/1978 | Asano | 123/32 EE |
| 4,137,713 | 2/1979 | Takeda | 60/276 |
| 4,147,030 | 4/1979 | Katahira | 60/276 |

*Primary Examiner*—Douglas Hart

*Attorney, Agent, or Firm*—Stevens, Davis, Miller & Mosher

[57] ABSTRACT

Disclosed is an apparatus for controlling the amount of secondary air fed into an internal combustion engine. The apparatus includes an independent means for rapidly applying an absolute pressure signal to a secondary air flow control means, so that secondary air is rapidly supplied into the engine when the secondary air flow control means is being reset in its initial position, and then, next, a rich signal is applied. Thus, the equivalent air-fuel ratio can be correctly controlled, without delay, in response to changes in the operating condition of the engine.

14 Claims, 8 Drawing Figures

APPARATUS FOR CONTROLLING THE AMOUNT OF SECONDARY AIR FED INTO AN INTERNAL COMBUSTION ENGINE

BACKGROUND OF THE INVENTION

The present invention relates to an apparatus for controlling the amount of secondary air fed into an intake passage or into an exhaust passage of an internal combustion engine for controlling an equivalent air-fuel ratio (if an air-fuel passage from the intake passage through exhaust passage located upstream of an air-fuel ratio sensor is defined as a working fluid passage, the equivalent air-fuel ratio is defined as a ratio of the amount of air fed into the working fluid passage to the amount of fuel fed into the working fluid passage) within a predetermined range.

In the field of this art, a method is known in which the equivalent air-fuel ratio is detected by an air-fuel ratio sensor, for example, an oxygen concentration sensor for detecting the concentration of oxygen in the exhaust gas, and; then, secondary air is fed into an intake passage or into an exhaust passage of an internal combustion engine according to the detected equivalent air-fuel ratio, for maintaining the equivalent air-fuel ratio within a predetermined range which is near the stoichiometric air-fuel ratio, whereby the effect of purifying pollutants in a three-way catalytic converter disposed in the exhaust system is improved.

In a conventional apparatus for carrying out the above-mentioned method, the amount of secondary air to be injected into the engine is controlled by an air flow control valve disposed in a passage between an air pump and a secondary air injection mechanism. The air flow control valve is driven by an absolute pressure signal applied thereto through an electromagnetic valve which is adapted for switching the transmission of the absolute pressure on or off in response to an electrical signal provided from the air-fuel ratio sensor. More specifically, when a lean signal, which indicates that the equivalent air-fuel ratio is on the lean side of the stoichiometric air-fuel ratio, is provided from the air-fuel ratio sensor, a diaphragm of the air flow control valve is not actuated by the absolute pressure signal and is pressed by a return spring, so as to form a passage for discharging the air fed from the air pump into the atmosphere. Further, when a rich signal, which indicates that the equivalent air-fuel ratio is on the rich side of the stoichiometric air-fuel ratio, is provided from the air-fuel ratio sensor, the diaphragm of the air flow control valve is actuated by the absolute pressure signal against the pressing force of the return spring, so as to form a passage for providing the air fed from the air pump to the secondary air injection mechanism. The absolute pressure signal may be a negative pressure signal using vacuum in an intake manifold of the engine as a carrier of the signal, or a positive pressure signal using, for example, the discharge pressure of the air pump as a carrier of the signal.

However, in the conventional apparatus of the above described type, when the duration of the lean signal exceeds a certain period, a time delay of the valve switching operation in response to the rich signal occurs. More specifically, when the duration of the lean signal exceeds a certain period, since the diaphragm of the air flow control valve completely returns to its initial position by receiving the pressing force caused by the return spring, the air flow control valve cannot immediately actuated to switch the passage of the secondary air in response to the next rich signal. Therefore, it is very difficult to control the equivalent air-fuel ratio within the predetermined range in this case.

SUMMARY OF THE INVENTION

It is, therefore, an object of the present invention to provide an apparatus for controlling the amount of secondary air fed into an internal combustion engine, whereby the equivalent air-fuel ratio can be correctly controlled, without delay, in response to changes in the operating condition of the engine.

According to the present invention, an apparatus for controlling the amount of secondary air fed into an internal combustion engine comprises: means for generating a first electrical signal of a level which indicates an equivalent air-fuel ratio condition; means for controlling the amount of secondary air to be fed into the engine in accordance with changes in the level of an absolute pressure signal applied thereto; a first applying means for applying an absolute pressure signal to the means for controlling the amount of secondary air in response to a specific level of the first electrical signal; means for generating a second electrical signal of a level which indicates that said air flow control valve is in the initial position, and; a second applying means for rapidly applying an absolute pressure signal to said means for controlling the amount of secondary air, in response to both said first electrical signal and said second electrical signal, said second applying means being constructed independently of said first applying means.

The above and other related objects and features of the present invention will be apparent from the following description of the present invention with reference to the accompanying drawings, as well as from the appended claims.

DETAILED DESCRIPTION OF THE INVENTION

Figure 1:
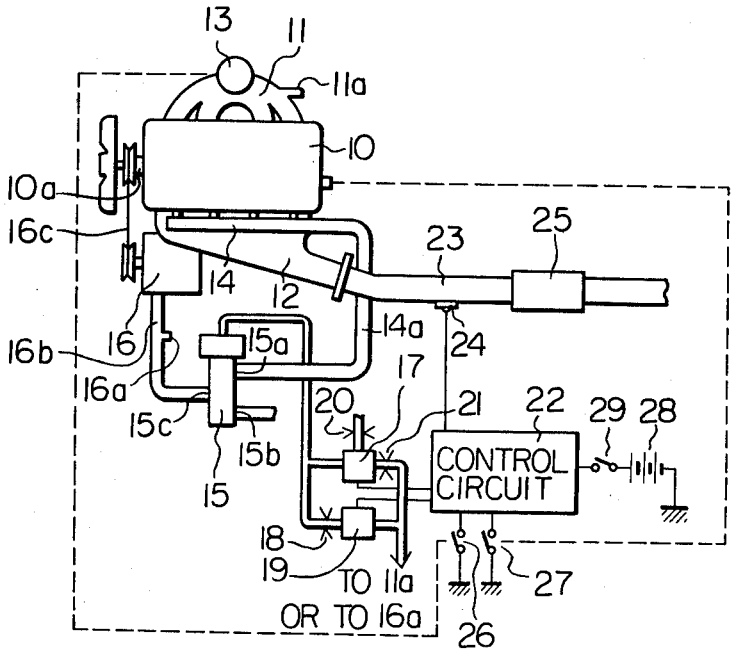
FIG. 1 is a schematic diagram of an internal combustion engine to which an apparatus for controlling the amount of secondary air according to the present invention is attached.

Referring to FIG. 1, which is a schematic diagram of an internal combustion engine having an apparatus according to the present invention, reference numeral 10 represents the body of the engine, 11 represents an intake manifold of the engine 10, 11*a* represents a vacuum take-out port of the intake manifold 11, and 12 represents an exhaust manifold of the engine 10. A carburetor 13 having a throttle valve (not shown) is mounted upstream of the intake manifold 11. A secondary air manifold 14 for injecting secondary air into the exhaust manifold 12 is mounted on the exhaust port portion of the exhaust manifold 12. The secondary air manifold 14 communicates via a conduit 14*a*, with a first port 15*a* of an air flow control valve 15 which is a diaphragm-type three-port valve. A check valve (not shown) is generally mounted on the conduit 14*a*. A second port 15*b* of the air flow control valve 15 is opened to the atmosphere via, for example, an air cleaner (not shown). A third port 15*c* of the air flow control valve 15 communicates via a conduit 16*b*, with the discharge outlet of an air pump 16 which is driven by a crankshaft 10*a* of the engine 10 via a belt 16*c*. A suction inlet (not shown) of the air pump 16 is opened to the atmosphere via, for example, an air cleaner (not shown). A diaphragm control chamber in the air flow control valve 15 communicates with a first port of an electromagnetic valve 17 of a three-port valve and via an orifice 18, with a first port of an electromagnetic valve 19 of a two-port valve. A second port of the electromagnetic valve 17 is opened to the atmosphere through an orifice 20 and preferably through an air cleaner (not shown). A third port of the electromagnetic valve 17 communicates via an orifice 21, with the vacuum take-out port 11*a* or with a positive pressure take-out port 16*a* on the conduit 16*b* for feeding the discharge pressure provided from the air pump 16. A second port of the electromagnetic valve 19 is also communicated with the vacuum take-out port 11*a* or with the positive pressure take-out port 16*a*.

Exciting coils (not shown) of the electromagnetic valves 17 and 19 are electrically connected to a control circuit 22, respectively. The electromagnetic valve 17 is arranged so that when the exciting coil thereof is energized, the diaphragm-control chamber of the air flow control valve 15 is communicated with the vacuum take-out port 11*a* or with the positive pressure take-out port 16*a*, and that when de-energized, the diaphram-control chamber is opened to the atmosphere. The other electromagnetic valve 19 is so arranged that when the exciting coil thereof is energized, the diaphragm-control chamber of the valve 15 is communicated with the port 11*a* or with the port 16*a*, and that when de-energized, this communication is cut off.

An exhaust pipe 23 is connected downstream of the exhaust manifold 12. An air-fuel ratio sensor 24, for example, an oxygen concentration sensor for detecting the equivalent air-fuel ratio is mounted on the exhaust pipe 23. A three-way catalytic converter 25 for reducing the three main pollutants, i.e., $NO_x$,CO and HC components, in the exhaust gas is mounted in the exhaust pipe 23 downstream of the air-fuel ratio sensor 24. The output terminal of the air-fuel ratio sensor 24 is electrically connected to the control circuit 22.

A throttle position switch 26 is interconnected with the throttle valve in the carburetor 13 for defecting a specific position of the throttle valve where the opening degree of the valve is greater than a predetermined value. One terminal of the throttle position switch 26 is electrically connected with the control circuit 22 and the other terminal of the switch 26 is grounded. An engine temperature switch 27 is mounted on a cylinder block of the engine 10 for detecting whether or not the engine coolant temperature is less than a predetermined level. One terminal of the engine temperature switch 27 is electrically connected to the control circuit 22 and the other terminal of the switch 27 is grounded. A positive side terminal of a battery 28 is electrically connected to a power input terminal 22*d* (shown in FIG. 3) of the control circuit through an ignition switch 29, and a negative side terminal of the battery 28 is grounded.

Figure 2A:
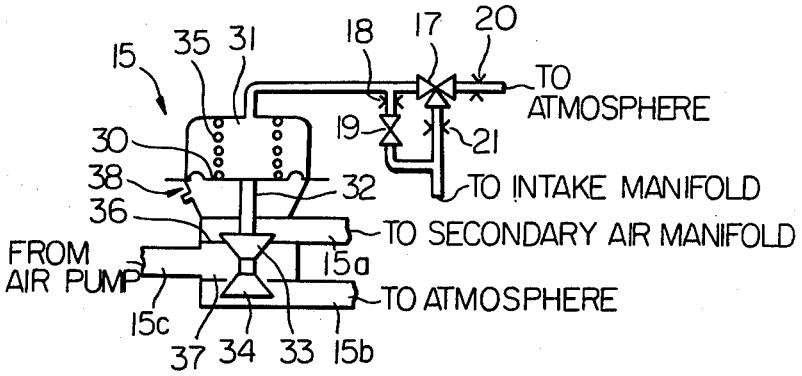
FIGS. 2*a* and 2*b* are schematic sectional diagrams illustrating two respective embodiments of an air flow control valve shown in FIG. 1.

FIG. 2*a* illustrates the structure of the air flow control valve 15 which uses vacuum in the intake manifold 11 as a carrier of the absolute pressure signal for driving the diaphragm of the valve 15. In FIG. 2*a*, reference numerals 30 and 31 represent a diaphragm and a diaphragm-control chamber, respectively. The diaphragm 30 is connected to valve members 33 and 34 by means of a rod 32. The mid portion of the rod 32 is slidably supported by a body 38 of the air flow control valve 15. A diaphragm-return spring 35 is disposed in the chamber 31 for the purpose of pressing against the diaphragm 30. This control valve 15 is so arranged that when the pressure level in the control chamber 31 is equal to the atmospheric pressure level, the valve member 33 is rested on a valve seat 36 and the valve member 34 is positioned apart from a valve seat 37, as shown in FIG. 2*a*. This state called the initial position. Therefore, when both of the electromagnetic valves 17 and 19 are electrically de-energized, since the pressure level in the control chamber 31 becomes equal to the atmospheric pressure level, the second port 15*b* is communicated with the third port 15*c*.

Contrary to the above, when at least one of the electromagnetic valves 17 and 19 is electrically energized, since the vacuum in the intake manifold 11 is applied to the control chamber 31, the diaphragm 30 is driven in a direction opposite that of the pressing force caused by the spring 35, and also, the valve members 33 and 34 are driven to open and to close the valve seats 36 and 37, respectively. Accordingly, in this case, the first port 15*a* is communicated with the third port 15*c*.

The orifices 18, 20 and 21 are adapted for controlling the driving speed of the diaphragm 30, namely for controlling the speed for transmitting the absolute pressure signal through each of these orifices, to a desirable speed. The inner diameters of these orifices are determined according to the response speed of the electromagnetic valves 17 and 19. However, the inner diameter of the orifice 18 should be greater than the inner diameter of the orifice 21.

Figure 2B:
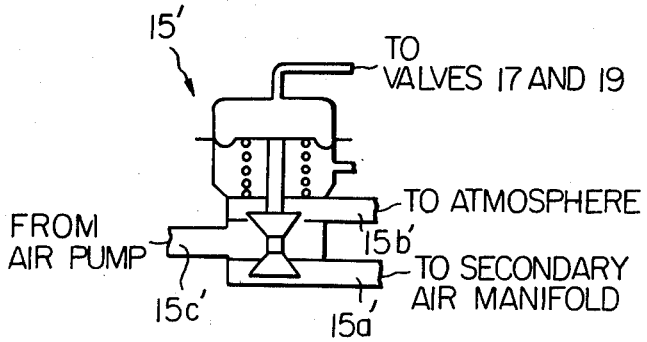

FIG. 2*b* illustrates the structure of another embodiment of the air flow control valve according to the present invention. This air flow control valve 15' has substantially the same function as that of the air flow control valve 15 shown in FIG. 2*a*, except that this control valve 15' is driven by the positive pressure signal which uses a carrier of, for example, the discharge pressure of the air pump 16, instead of being driven by the negative pressure signal which uses a carrier of the vacuum in the intake manifold 11.

Figure 3:
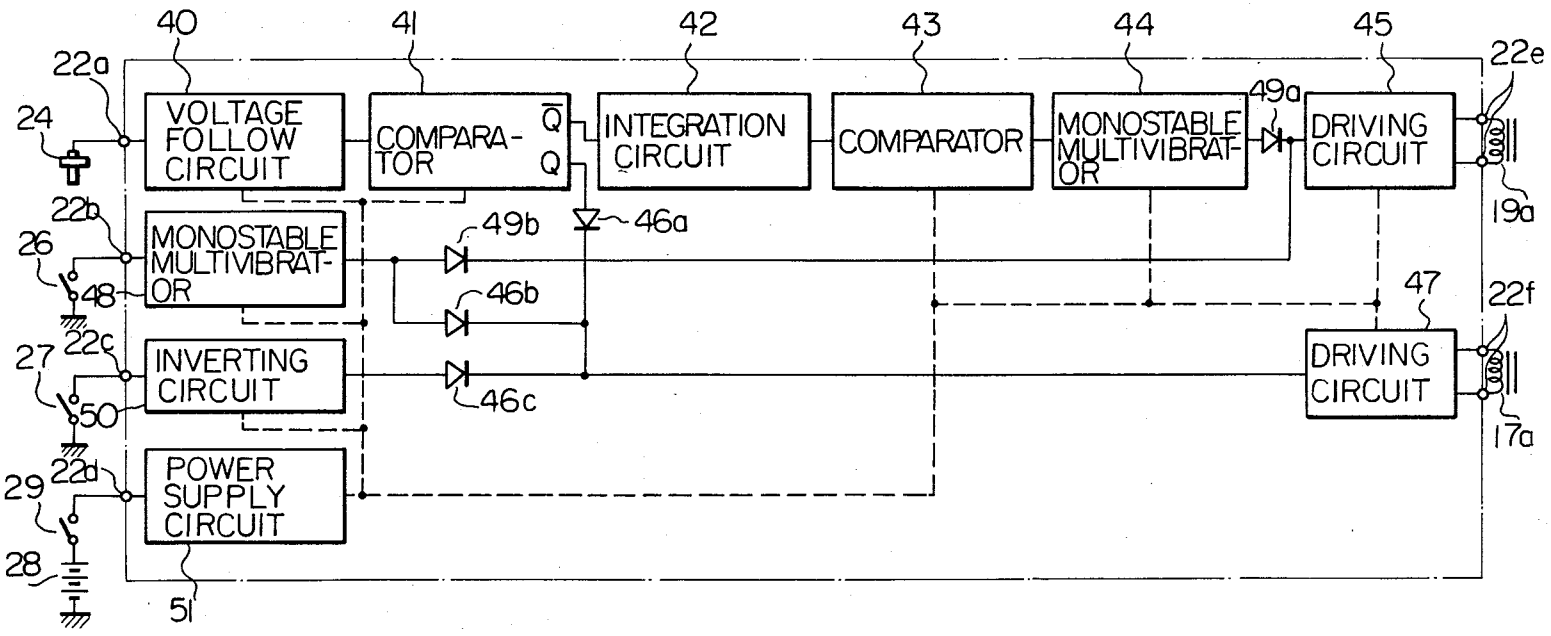
FIG. 3 is a block diagram of a control circuit shown in FIG. 1.

FIG. 3 is a block diagram illustrating the control circuit 22 shown in FIG. 1. As shown in FIG. 3, the output terminal of the air-fuel ratio sensor 24 is connected to the input terminal of a voltage follow circuit 40 through an input terminal 22*a*. The output terminal of the voltage follow circuit 40 is connected to the input terminal of a first comparator 41. The output terminal $\overline{Q}$ of the first comparator 41 is connected to the input terminal of a second comparator 43 through an integration circuit 42. The output terminal of the comparator 43 is connected to the input terminal of a first monostable multivibrator 44. The output terminal of the monostable multivibrator 44 is connected to an exciting coil 19*a* of the electromagnetic valve 19 through a diode 49*a*, a driving circuit 45 and an output terminal 22*e*. The other output terminal Q of the first comparator 41 is connected to the input terminal of a driving circuit 47 through a diode 46*a*, and the output terminal of this driving circuit 47 is connected to an exciting coil 17*a* of the electromagnetic valve 17 through an output terminal 22*f*. One terminal of the throttle position switch 26 is connected to the input terminal of a monostable multivibrator 48 through an input terminal 22*b*. The output terminal of the monostable multivibrator 48 is connected to the input terminal of the driving circuit 47 through a diode 46*b* and also connected to the input terminal of another driving circuit 45 through a diode 49*b*. One terminal of the engine temperature switch 27 is connected to the input terminal of an inverting circuit 50 through an input terminal 22*c*. The output terminal of the inverting circuit 50 is connected to the input terminal of the driving circuit 47 via a diode 46*c*. The positive side terminal of the battery 28 is connected to the input terminal of a power supply circuit 51 through the ignition switch 29 and an input terminal 22*d*. The output terminal of the power supply circuit 51 is connected, as shown by the broken lines in FIG. 3, to each of the power input terminals of the above-mentioned circuits, respectively. Each of the aforementioned groups of diodes 46*a*, 46*b* and 46*c* and diodes 49*a* and 49*b* forms a kind of OR circuit, respectively.

Figure 4:
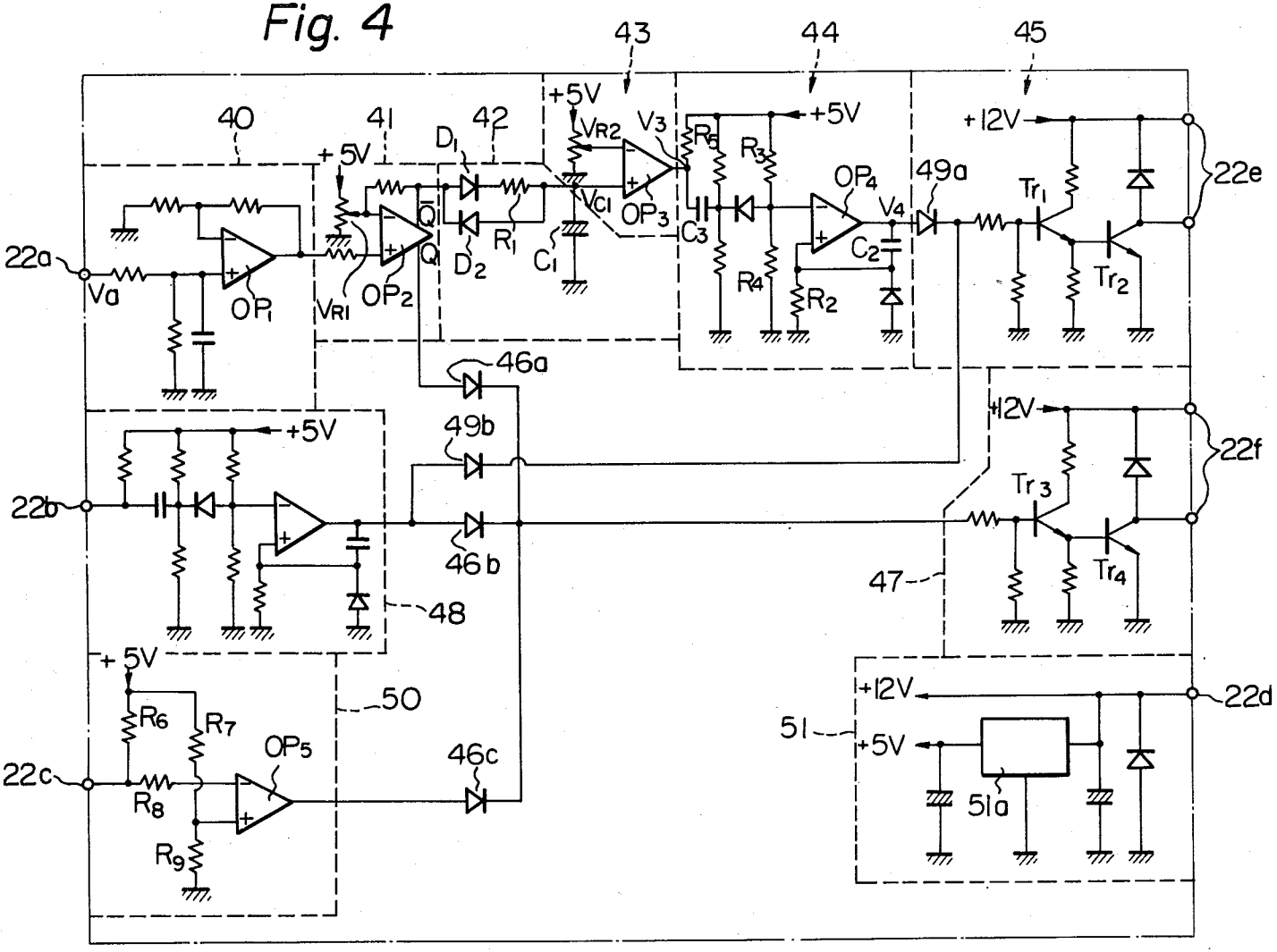
FIG. 4 is a detailed circuit diagram of the control circuit shown in FIG. 3.

FIG. 4 is a detailed circuit diagram illustrating the control circuit 22 shown in FIG. 3. The structure and operation of the control circuit 22 will now be described in detail with reference to FIG. 4.

The voltage follow circuit 40 is a well-known circuit in which an operational amplifier $OP_1$ is used as a non-inverting amplifier having the gain being equal to 1. This voltage follow circuit 40 is adapted for improving the operating characteristics of the comparator 41 and the accuracy of the comparison function of the comparator 41 by matching the output impedance of the air-fuel ratio sensor 24 with the input impedance of the comparator 41. However, this voltage follow circuit 40 may be omitted if the structure of the comparator 41 is appropriately arranged so that the input impedance of the comparator 41 can be matched with the output impedance of the air-fuel ratio sensor 24.

The first comparator 41 is composed of an operational amplifier $OP_2$ with a non-inverting input terminal to which an input signal to be compared with is transmitted, and an inverting input terminal to which a reference voltage is transmitted. This operational amplifier $OP_2$ is composed of an operational amplifier, such as 760C, with a non-inverting output terminal, namely the output terminal Q, and an inverting output terminal, namely the output terminal $\overline{Q}$ which is complementally interconnected with the output terminal Q. The level of the reference voltage $V_{R1}$ is maintained at a predetermined voltage level of about 0.5 V. Therefore, when the level of the input signal $V_a$ transmitted from the air-fuel ratio sensor 24 via the input terminal 22*a* to the non-inverting input terminal is higher than the reference voltage level, high and low level output signals appear on the output terminals Q and $\overline{Q}$ respectively, and; when the level of the above-mentioned input signal is lower than the reference voltage level, low and high level output signals appear on the output terminals Q and $\overline{Q}$, respectively. It is well known that such as operational amplifier $OP_2$ can also be realized by a combination of a normal operational amplifier and a level inverting element.

The integration circuit 42 is a kind of charging-discharging circuit which is composed of a resistor $R_1$, a capacitor $C_1$ and two diodes $D_1$ and $D_2$. When the level of an input signal of the integration circuit 42 becomes too high, charging current of the capacitor $C_1$ flows through the diode $D_1$ and resistor $R_1$, and the capacitor $C_1$ gradually charges in accordance with the time constant which is determined by the resistance value of the resistor $R_1$ and the capacitance value of the capacitor $C_1$. When the level of the input signal changes to low, discharging current of the capacitor $C_1$ flows through the diode $D_2$ and the capacitor $C_1$ rapidly discharges.

The second comparator 43 is composed of an operational amplifier $OP_3$ with a non-inverting input terminal to which a comparing input signal, namely, the voltage $V_{C1}$ developed across the capacitor $C_1$ of the integration circuit 42, is transmitted, and an inverting input terminal to which a constant reference voltage $V_{R2}$ is transmitted. Therefore, when the level of the voltage $V_{C1}$ is higher than the level of the reference voltage $V_{R2}$, a high level signal is fed to the input terminal of the first monostable multivibrator 44. Contrary to this, when the level of the voltage $V_{C1}$ is lower than the reference voltage level, a low level signal is fed to the input terminal of the monostable multivibrator 44.

The first monostable multivibrator 44 has a known circuit structure which includes an operational amplifier $OP_4$. As shown in FIG. 4, a capacitor $C_2$ is connected between the non-inverting input terminal and the output terminal of the operational amplifier $OP_4$. A resistor $R_2$ is connected between the non-inverting input terminal of the operational amplifier $OP_4$ and the earth. The inverting input terminal of the operational amplifier $OP_4$ is connected to a junction point of two bias resistors $R_3$ and $R_4$ which are connected in series. The junction point is connected to the input terminal of the monostable multivibrator 44 via a capacitor $C_3$. This input terminal is also connected to the output terminal of a constant voltage supply circuit 51*a* through a resistor $R_5$. Since the bias voltage is applied to the inverting input terminal of the operational amplifier $OP_4$, the level of the output voltage of the operational amplifier $OP_4$ is generally maintained at a low level. When the level of the input voltage applied to the non-inverting input terminal is changed to a low level, the output voltage level of the operational amplifier $OP_4$ is increased to a high level. The voltage level at the non-inverting input terminal of the operational amplifier $OP_4$ is transiently increased to a high level simultaneously with the above-mentioned change of the output voltage level, and then, is gradually decreased according to the time constant which is determined by the capacitance value of the capacitor $C_2$ and by the resistance value of the resistor $R_2$. The output voltage level of the operational amplifier $OP_4$ is changed again to a low level when the voltage level at the non-inverting input terminal of the operational amplifier $OP_4$ is lower than the level of the bias voltage applied to the inverting input terminal of the amplifier $OP_4$. In other words, the monostable multivibrator 44 shown in FIG. 4 generates a high level signal having a predetermined duration each time the level of the signal applied to the input terminal thereof is changed from a high level to a low level. This duration is determined by the time constant which is derived from the capacitance value of the capacitor $C_2$ and the resistance value of the resistor $R_2$ by the power supply voltage and by the resistance values of the bias resistors $R_3$ and $R_4$. As is well-known, the monostable multivibrator of the control circuit 22 can be formed by using various circuits other than the circuit shown in FIG. 4.

The structure and operation of the second monostable multivibrator 48 is the same as that of the above-mentioned first monostable multivibrator 44.

The inverting circuit 50 is composed of an operational amplifier $OP_5$, resistors $R_6$ and $R_7$ of the same resistance value, and resistors $R_8$ and $R_9$ of the same resistance value. This inverting circuit 50 is adapted for obtaining an output voltage having a level which is an inversion of the level of the input voltage, and can be embodied by various circuits other than the circuit shown in FIG. 4. Furthermore, this inverting circuit 50 should be omitted in the case where an engine temperature switch connected to the input terminal 22*c*, which generates a level contrary to the output signal level of the engine temperature switch 27 according to the present embodiment, is used.

The driving circuit 45, as shown in FIG. 4, comprises a pair of switching transistors $Tr_1$ and $Tr_2$. The driving circuit 47 comprises a pair of switching transistors $Tr_3$ and $Tr_4$. When a high level signal is applied to the input terminal of the driving circuit 45 (47), one pair of transistors $Tr_1$ and $Tr_2$ ($Tr_3$ and $Tr_4$) becomes conductive. As a result, in this case, a source voltage of 12 V, which is fed from the power supply circuit 51, appears at each of the output terminals 22*e* and 22*f*, respectively.

The power supply circuit 51 is arranged so as to feed the source voltage of 12 V, which is applied from the battery 28 to the driving circuits 45 and 47, and the voltage of 5 V, which is regulated by means of the constant voltage supply circuit 51*a*, to the above-mentioned voltage follow circuit 40, comparators 41 and 43, monostable multivibrators 44 and 48, and inverting circuit 50.

The operation of the apparatus of the present embodiment will now be described.

First of all, the operation of the apparatus occurring when the engine is in a normal operating condition is illustrated hereinafter. In this case, since the opening degree of the throttle valve is less than a predetermined value, the throttle position switch 26 is thus opened. Furthermore, since the temperature of the engine coolant is high enough, the engine temperature switch 27 is also opened. Therefore, in this case, no other electrical signal is applied to the control circuit 22 except for an electrical signal fed back from the air-fuel ratio sensor 24. Accordingly, the apparatus of the present embodiment is controlled only by an electrical signal provided from the air-fuel ratio sensor 24.

Figure 6:
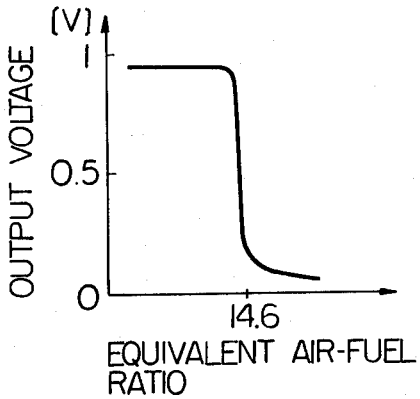
FIG. 6 is a graph illustrating the characteristics of an air-fuel ratio sensor shown in FIG. 1.

The air-fuel ratio sensor 24 of this embodiment is a well-known oxygen concentration sensor using zirconium oxide as an oxygen ion conductor. As shown in FIG. 6, the air-fuel ratio sensor 24 generates an output voltage of about 1 V when the equvalent air-fuel ratio is lower than the stoichiometric air-fuel ratio, namely, when the equivalent air-fuel ratio is on the rich side of stoichiometric conditions. Furthermore, the sensor 24 generates an output voltage of about 0.1 to 0.2 V when the equivalent air-fuel ratio is higher than the stoichiometric air-fuel ratio, namely when the equivalent air-fuel ratio is on the lean side of stoichiometric conditions.

Figure 5:
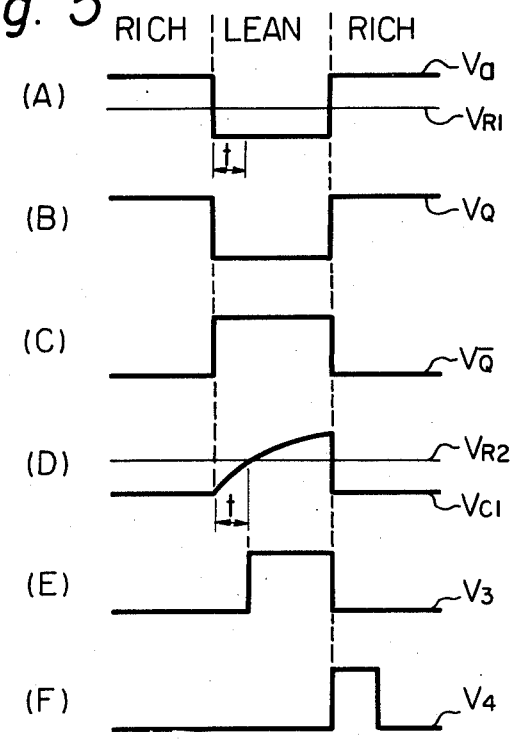
FIG. 5 shows waveforms obtained at various points in the control circuit shown in FIG. 4.

As shown in FIG. 5-(A), the output voltage $V_a$ of the air-fuel ratio sensor 24 is applied to the first comparator 41, via the voltage follow circuit 40, for matching the imput impedance of the comparator 41, with the output impedance of the air-fuel ratio sensor 24, and the level of the output voltage $V_a$ of the sensor 24 is compared with the level of the reference voltage $V_{R1}$. Thus, as shown in FIG. 5-(B), while a rich signal, which indicates that the equivalent air-fuel ratio is on the rich side of stoichiometric conditions, is generated, a high level voltage $V_Q$ appears on the output terminal Q of the comparator 41. As a result, the driving circuit 47 is actuated to energize the electomagnetic valve 17. Furthermore, in this case, a low level voltage $V_{\overline{Q}}$, shown in FIG. 5-(C), appears on the output terminal $\overline{Q}$ of the comparator 41. Therefore, the capacitor $C_1$ of the integration circuit 42 is completely discharged and, thus, as shown in FIG. 5-(D) and (E), the output voltage $V_3$ of the second comparator 43 is maintained at a low level. As a result, the first monostable multivibrator 44 is not triggered in this case.

When the electromagnetic valve 17 is energized, in the case of the air flow control valve which is driven by negative pressure, for example, a vacuum in the intake manifold 11, as the absolute pressure for driving the diaphragm thereof, the negative pressure is gradually applied to the diaphragm control chamber 31 of the air flow control valve 15 via the orifice 21, and; the secondary air which is pushed by the air pump 16 is gradually injected into the exhaust manifold 12 of the engine via the air flow control valve 15 and the secondary air manifold 14. As a result, the equivalent air-fuel ratio is gradually controlled so that it moves into the lean side of stoichiomatric conditions.

When the equivalent air-fuel ratio is controlled so that it can be changed into the lean side, the output voltage $V_a$ of the air-fuel ratio sensor 24 is changed to a low level (this called a lean signal), which is lower than the level of the reference voltage $V_{R1}$, as shown in FIG. 5-(A), and the output voltage $V_Q$ of the comparator 41 is changed to a low level, as shown in FIG. 5-(B). Therefore, the electromagnetic valve 17 is de-energized to cause the pressure in the diaphragm control chamber 31 to gradually change from the negative pressure level to the atmospheric pressure level, which atmospheric pressure is applied thereto through the orifice 20. Thus, as mentioned above, the air flow control valve 15 is actuated so as to discharge the air which is pushed by the air pump 16, into the atmosphere through, for example, an air cleaner.

As shown in FIG. 5-(C), since the inverting output voltage $V_{\overline{Q}}$ of the first comparator 41 is maintained at a high level in this case, namely during the time a lean signal exists, the capacitor $C_1$ of the integration circuit 42 is gradually charged by the charging current which is transmitted through the diode $D_1$ and resistor $R_1$. Therefore, the voltage $V_{C1}$, developed across the capacitor $C_2$ gradually increases according to the time constant determined by the resistance value of the resistor $R_1$ and the capacitance value of the capacitor $C_1$, as shown in FIG. 5-(D). When the duration of the lean signal exceeds a predetermined period t, the level of the voltage $V_{C1}$ increases higher than the level of the reference voltage $V_{R2}$ of the comparator 43, and the output voltage $V_3$ (shown in FIG. 5-(D) and (E)) of the comparator 43 is changed to a high level. After that, when the equivalent air-fuel ratio is controlled so that it can be changed into the rich side of stoichiometric conditions, and thus the inverting output voltage $V_{\overline{Q}}$ is changed to the low level, since the voltage $V_{C1}$ is decreased to the low level by the aforementioned discharging operation, the output voltage $V_3$ of the comparator 43 changes to the low level again, as shown in FIG. 5-(E). As a result, the first monostable multivibrator 44 is triggered at the time the level of the output voltage $V_3$ changes from high to low and generates a high level signal $V_4$, shown in FIG. 5-(F), having a predetermined duration. In other words, when the lean signal lasts for a time longer than the predetermined period t and after that the rich signal is applied, a high level signal $V_4$ with a certain duration is generated simultaneously with the rich signal. This high level signal $V_4$ is applied to the driving circuit 45 so as to energize the electromagnetic valve 19.

When the electromagnetic valve 19 is energized and opened, since the inner diameter of the orifice 18, which is utilized to regulate the speed of transmitting negative pressure through the valve 19, is large, negative pressure is rapidly applied to the diaphragm control chamber 31 of the air flow control valve 15. Therefore, the air flow control valve 15 is instantaneously controlled so that secondary air is quickly injected into the exhaust manifold 12 of the engine without any delay, even if the air flow control valve 15 is in an initial position.

As described above, the apparatus according to the present embodiment is constructed so as to monitor indirectly whether the air flow control valve 15 is in its initial position or not, by means of monitoring whether the duration of the lean signal exceeds the predetermined period of time or not. Therefore, the level of the input voltage of the integration circuit 42, the time constant of the integration circuit 42 and the level of the reference voltage $V_{R2}$ of the second comparator 43 should be determined so that the aforementioned period t for being compared with the duration of the lean signal corresponds to the time which is required for the air flow control valve 15 to return to its initial position.

When the opening degree of the throttle valve exceeds the predetermined value due to, for example, the accelaration of the engine, the throttle position switch 26 is closed to cause the second monostable multivibrator 48 to produce a high level voltage corresponding to a predetermined duration. Both of the driving circuits 45 and 47 are simultaneously actuated by the high level voltage produced by the second monostable multivibrator 48 to energize the electromagnetic valves 17 and 19, respectively. As a result, secondary air is rapidly injected into the exhaust manifold 12 in the same manner as in the above-mentioned case. Namely, even if the opening degree of the throttle valve exceeds the predetermined value and the air-fuel ratio of the air-fuel mixture fed into the cylinder of the engine is rapidly changed to be on the rich side of the stoichiometric air-fuel ratio, the equivalent air-fuel ratio will be controlled within the predetermined range without any delay.

Figure 7:
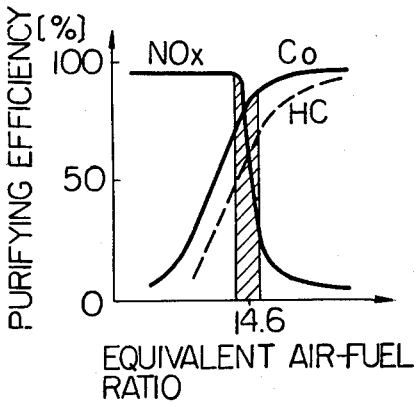
FIG. 7 is a graph illustrating the characteristics of a three-way catalytic converter shown in FIG. 1.

Accordingly, the three-way catalytic converter 25 mounted on the exhaust pipe 23 can be used to effectively purify the pollutants, even when the lean signal lasts for a long time and the air flow control valve 15 returns to its initial position, or even when the engine is accelerated. This is because the three-way catalytic converter has operating characteristics as shown in FIG. 7, which illustrates the relationship between the purifying efficiency of the three-way catalytic converter and the equivalent air-fuel ratio. As shown in FIG. 7, the three-way catalytic converter can attain the highest efficiency in simultaneously purifying the three main harmful pollutants in the exhaust gas when the equivalent air-fuel ratio is within a very narrow range (shown as the hatched zone in FIG. 7) which is near the stoichiometric air-fuel ratio.

In the foregoing embodiment, the electromagnetic valves 17 and 19 are both energized by the high level voltage applied from the second monostable multivibrator 48. However, in another embodiment, the monostable multivibrator 48 may be arranged so as to energize only the electromagnetic valve 19.

The operation of the apparatus of the present embodiment occurring when the temperature of the engine coolant is lower than a predetermined value, for example, 50° C., and occurring when the engine temperature switch 27 is closed is now illustrated.

In this case, since a low level signal is applied to the inverting circuit 50, the level of the output voltage of the inverting circuit 50 is maintained at a high level. As a result, the driving circuit 47 is actuated to energize the electromagnetic valve 17. Therefore, in this case, secondary air is injected into the exhaust manifold 12 in the same manner as described above. When the temperature of the coolant exceeds the predetermined value, the engine temperature switch 27 is opened and the operation of injecting secondary air into the engine in response to the temperature of the coolant is stopped. Thereafter, control of the secondary air injection is performed in accordance with the signals generated from the air-fuel ratio sensor 24 and from the throttle position switch 26. As described above, the present apparatus is arranged so that when the engine temperature is low, the equivalent air-fuel ratio is forcibly controlled so that it is on the lean side by injecting secondary air into the exhaust gas. Accordingly, in this case, the three-way catalytic converter acts as an oxidation catalytic converter, and the CO and HC components in the exhaust gas are thereby effectively reduced. This is because when the engine temperature is low, since the air-fuel ratio sensor is inactive, the air-fuel feedback control based on the signal generated from the air-fuel ratio sensor cannot be performed. Furthermore, in this case, the temperature of the catalytic converter is low and the amount of the $NO_x$ component contained in the exhaust gas is very small.

As will be apparent from the foregoing description, since the apparatus for controlling the amount of secondary air fed into the engine according to the present invention comprises means for rapidly applying the absolute pressure signal to a secondary air flow control means when the secondary air flow control means, which has already returned to its initial position, is actuated, namely when the equivalent air-fuel ratio is maintained on the lean side of stoichiometric conditions for a time longer than the predetermined period and after that is changed to the rich side, the response speed of the secondary air flow control means is remarkably increased. As a result, the equivalent air-fuel ratio can be controlled precisely in response to changes in the operating condition of the engine, without delay. Further, since the apparatus according to the present invention also comprises means for rapidly applying the absolute pressure signal to the secondary air flow control means when the opening degree of the throttle valve exceeds a predetermined value, the equivalent air-fuel ratio can be controlled more precisely and without delay.

Accordingly, the purifying efficiency of the three-way catalytic converter can be remarkably improved. Furthermore, the apparatus according to the present invention is advantageous in that its structure is very simple and its manufacturing cost is very low.

As many widely different embodiments of the present invention may be constructed without departing from the spirit and scope of the present invention, it should be understood that the present invention is not limited to the specific embodiments described in this specification, except as defined in the appended claims.

What is claimed is:

1. An apparatus for controlling the amount of secondary air fed into an internal combustion engine, comprising:

means for generating a first electrical signal of a level which indicates an equivalent air-fuel ratio condition of said engine;

means including a secondary air flow control valve, having an initial position, for controlling the amount of secondary air to be fed into said engine, in accordance with a predetermined change in the level of an absolute pressure signal applied thereto;

a first applying means for applying an absolute pressure signal to said means for controlling the amount of secondary air, in response to a predetermined level of said first electrical signal;

means for generating a second electrical signal of a level which indicates that said air flow control valve is in the initial position, and;

a second applying means for rapidly applying an absolute pressure signal to said means for controlling the amount of secondary air, in response to both of said first electrical signal and said second electrical signal, said second applying means being constructed to be operated independently of said first applying means.

2. An apparatus for contolling the amount of secondary air fed into an internal combustion engine as claimed in claim 1, wherein said means for generating a second electrical signal includes an electrical means for generating said second electrical signal from said first electrical signal.

3. An apparatus for controlling the amount of secondary air fed into an internal combustion engine as claimed in claim 2, wherein said electrical means includes an electrical circuit for generating a second electrical signal when the duration of a specific level of said first electrical signal, which level indicates a fuel-lean condition of the engine, exceeds a predetermined period.

4. An apparatus for controlling the amount of secondary air fed into an internal combusion engine as claimed in claim 1, wherein said means for controlling the amount of secondary air includes means for injecting secondary air into said engine when the level of said absolute pressure signal is more than a predetermined value.

5. An apparatus for controlling the amount of secondary air fed into an internal combustion engine as claimed in claim 4, wherein said engine has an air pump for driving secondary air, wherein said means for injecting secondary air comprises an air flow control valve for controlling the amount air fed from said air pump to said engine.

6. An apparatus for controlling the amount of secondary air fed into an internal combustion engine as claimed in claim 1, wherein said first applying means includes means for applying said absolute pressure signal to said means for controlling the amount of secondary air when the level of said first electrical signal indicates a fuel-rich condition of the exhaust gas in said engine.

7. An apparatus for controlling the amount of secondary air fed into an internal combustion engine as claimed in claim 6, wherein said first applying means comprises an electromagnetic control valve which is energized by said first electrical signal so as to apply said absolute pressure signal to said means for controlling the amount of secondary air.

8. An apparatus for controlling the amount of secondary air fed into an internal combustion engine as claimed in claim 1, wherein said second applying means includes means for rapidly applying said absolute pressure signal to said means for controlling the amount of secondary air, for a predetermined period when said second electrical signal is generated and, then, the level of said first electrical signal is changed to a level which indicates a fuel-rich condition of the exhaust gas in said engine.

9. An apparatus for controlling the amount of secondary air fed into an internal combustion engine as claimed in claim 8, wherein said second applying means comprises a monostable multivibrator triggered by the negative edge of said second electrical signal, and an electromagnetic control valve which is energized by an output signal provided from said monostable multivibrator so as to rapidly apply said absolute pressure signal to said means for controlling the amount of secondary air.

10. An apparatus for controlling the amount of secondary air fed into an internal combustion engine as claimed in claim 1, wherein said engine has an intake manifold, wherein said absolute pressure signal includes a negative pressure signal applied from said intake manifold.

11. An apparatus for controlling the amount of secondary air fed into an internal combustion engine as claimed in claim 1, wherein said engine has an air pump for driving secondary air, wherein said absolute pressure signal includes a positive pressure signal applied from said air pump.

12. An apparatus for controlling the amount of secondary air fed into an internal combustion engine as claimed in claim 1, wherein said means for generating a first electrical signal comprises an air-fuel ratio sensor for selectively generating an electrical signal having two voltage levels in response to the concentration value of a predetermined constituent gas in said exhaust gas, and a comparator for comparing the level of said generated electrical signal of said air-fuel ratio sensor with a predetermined reference voltage.

13. An apparatus for controlling the amount of secondary air fed into an internal combustion engine as claimed in claim 1, wherein said engine has at least one throttle valve, and wherein said apparatus further comprises means for generating a third electrical signal of a level which indicates that the opening degree of said throttle valve is more than a predetermined value, and means for rapidly applying an absolute pressure signal to said means for controlling the amount of secondary air, in response to said third electrical signal.

14. An apparatus for controlling the amount of secondary air fed into an internal combustion engine as claimed in claim 1, wherein said apparatus further comprises means for generating a fourth electrical signal of a predetermined level which indicates that the value of the temperature of said engine is less than a predetermined level, and means for applying an absolute pressure signal to said means for controlling the amount of secondary air when said fourth electrical signal is applied thereto.

* * * * *